United States Patent [19]

Bremer, Jr.

[11] 4,237,708

[45] Dec. 9, 1980

[54] PRISONER LEG RESTRAINER

[76] Inventor: Karl W. Bremer, Jr., 1724 S. Orange Ave., Orlando, Fla. 32806

[21] Appl. No.: 54,170

[22] Filed: Jul. 2, 1979

[51] Int. Cl.[3] ..... E05B 75/00

[52] U.S. Cl. ..... 70/16; 128/133

[58] Field of Search ..... 70/14, 15, 16, 17, 18; 119/126, 127, 128; 128/133, 134, 135

[56] References Cited

U.S. PATENT DOCUMENTS

| | | | |
|---|---|---|---|
| 941,942 | 11/1909 | Nagle | 70/16 |
| 1,082,230 | 12/1913 | Nagle | 70/16 |
| 2,006,743 | 7/1935 | Nagle | 70/16 |
| 2,724,256 | 11/1955 | Bezona | 70/16 |

*Primary Examiner*—Robert L. Wolfe

*Attorney, Agent, or Firm*—Duckworth, Hobby, Allen & Pettis

[57] ABSTRACT

A prisoner leg restrainer is attachable to one leg of a prisoner wearing a belt. The leg restrainer includes first and second brace elements which are pivotably coupled together by a hinge. Straps are provided to couple the first and second brace elements to the leg of the prisoner. A locking mechanism automatically engages when the upper and lower sections of the leg restrainer are in vertical alignment to prevent rearward pivotal movement of the prisoner's leg.

15 Claims, 12 Drawing Figures

PRISONER LEG RESTRAINER

BACKGROUND OF THE INVENTION

1. Field of the Invention

The present invention relates to prisoner leg restrainers, and more particularly to leg restrainers having a pair of vertically oriented brace elements and an automatic locking device.

2. Description of the Prior Art

The prior art discloses a variety of limb restraints for immobilizing the arms or legs of a prisoner. U.S. Pat. No. 2,724,256 (Benzona) discloses a leg iron having a fixed diameter circular band at the upper end thereof which fits around the upper leg section of the wearer. A foot stirrup surrounds the wearer's foot and is secured to the ankle section of the wearer by a shackle. The circular band is coupled to the shackle and foot stirrup by two vertically oriented brace sections which are pivotally secured together by a hinge. A collar is provided to engage the hinge section of the leg iron and includes a set screw which permits the collar to be mechanically secured about a section of the hinge to prevent deflection of the brace assembly.

U.S. Pat. No. 1,082,229 (Nagle) discloses a leg restrainer having a vertically oriented brace section and a pair of hinges coupled to the vertically oriented brace section which divide the brace into three sections. Three chains secure the leg restrainer to the waist, knee section and ankle section of the wearer's body. U.S. Pat. No. 2,006,743 (Nagle) discloses another type of leg restrainer which includes a locking mechanism which permits the wearer's leg to be bent freely at the knee within a limited range, but which automatically locks the two sections of the leg restrainer at a predetermined angle if the knee is bent beyond a predetermined deflection. When locked the prisoner leg restrainer prevents the wearer's leg from being straightened.

U.S. Pat. No. 941,942 (Nagle) discloses a related type of leg restrainer which permits walking, but is so constructed that the elements lock in a rigid position when the wearer deflects his lower leg beyond a predetermined angle.

SUMMARY OF THE INVENTION

The present invention contemplates a prisoner leg restrainer attachable to one leg of a prisoner wearing belt. The leg restrainer comprises first and second brace elements which are positionable vertically along the inner and outer sides of the leg. Each brace section includes an upper section having a flat, downward sloping lower edge, a lower section having a flat, upward sloping upper edge, and a hinge pivotally coupling the upper and lower sections together to permit rearward pivotal movement of the lower sections of the leg restrainer with respect to the upper sections of the leg restrainer. First and second support means are coupled respectively to the upper and lower sections of the first and second brace elements to maintain a predetermined fixed lateral spacing between these brace elements. Securing means are provided to couple the first and second brace elements to the upper and lower portions of the leg of the prisoner. An automatic locking mechanism is provided to prevent rearward pivotal movement of the lower sections of the leg restrainer when engaged and automatically engages when the upper and the lower sections of the leg restrainer are in vertical alignment. The locking mechanism includes a collar coupled to and surrounding one of the brace elements. The collar is displacable downward along the brace element from a first retracted position above the upper edge of the upper section of the brace element into a second locked position in which the collar surrounds portions of both the upper and lower sections of the brace element. Biasing mean is coupled to the collar and to the brace element for biasing the collar into the second position. The collar is automatically displaced into the second position when the upper and lower sections of the brace elements are vertically aligned and thereby prevents rearward pivotal movement of the lower sections of the leg restrainer with respect to the upper sections.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
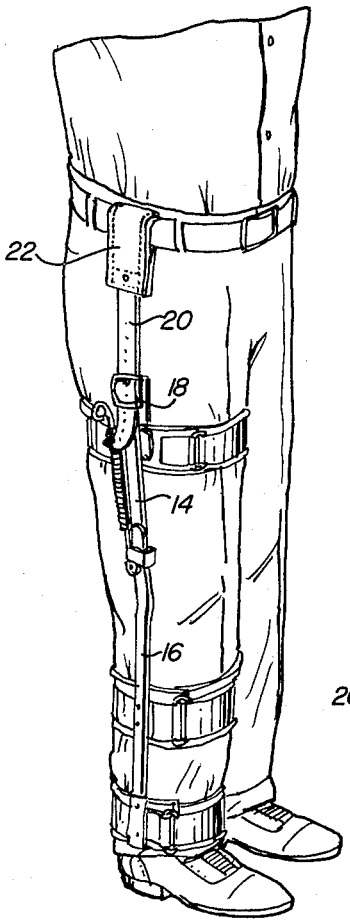
FIG. 1 is a perspective view of a preferred embodiment of the prisoner leg restrainer showing the manner in which the leg restrainer is attached to a prisoner.
Figure 2:
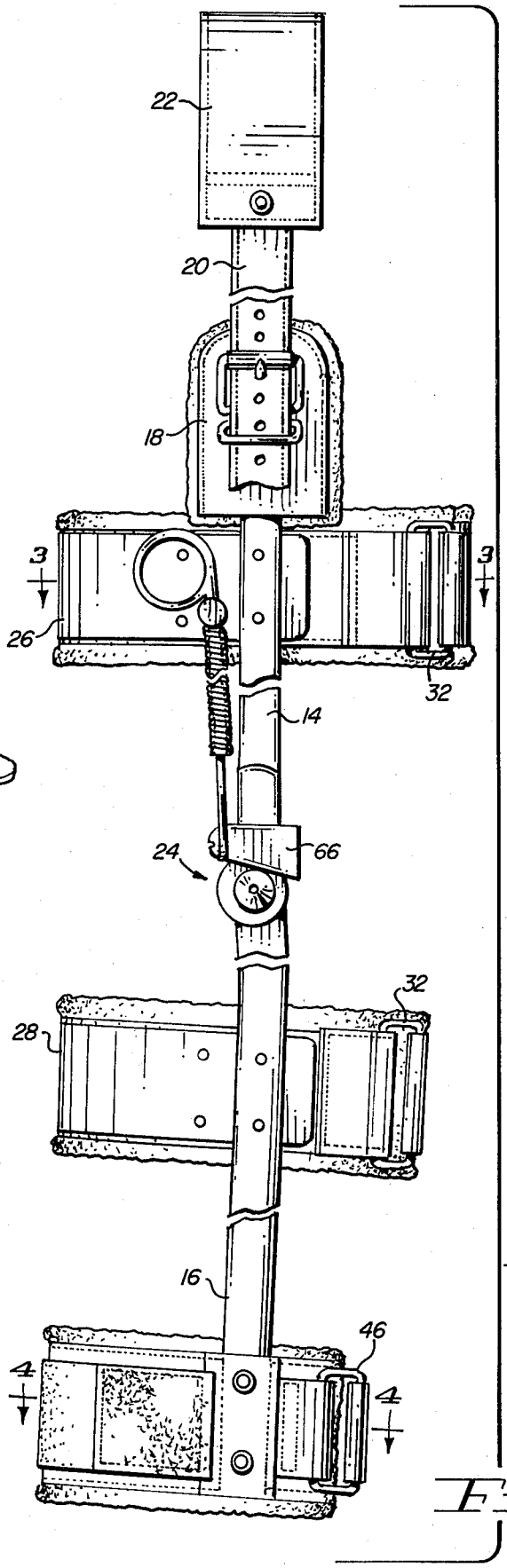
FIG. 2 is a partially cut away side view of the prisoner leg restrainer illustrated in FIG. 1.
Figure 10:
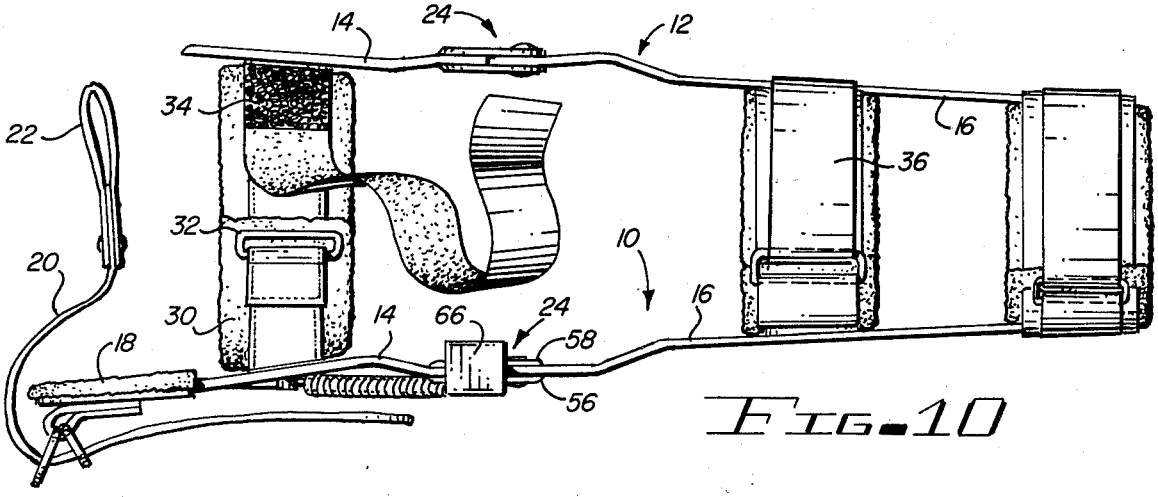
FIG. 10 is a front view of the prisoner leg restrainer illustrated in FIG. 1.

Referring now to FIGS. 1, 2 and 10, the prisoner leg restrainer of the present invention is attachable to one leg of a prisoner who is wearing a belt around his waist. The leg restrainer includes first and second brace elements 10 and 12. Each brace element includes an upper section 14 and a lower section 16 which are typically fabricated from aluminum alloy to minimize the weight of the structural elements of the present invention. As is best illustrated in FIG. 10, brace elements 10 and 12 are fabricated with a contour somewhat similar to the contour of a wearer's leg and knee joint area. A padded leather buckle section 18 is secured by rivets to the elongated outer upper section 14 of brace element 10.

The padding provided on the inner surface of buckle section 18 minimizes wearer discomfort. A leather strap 20 includes a belt loop 22 through which the belt of the wearer is passed. The distance which belt loop 22 extends above buckle section 18 is adjusted so that the axis of the hinges 24 is aligned with the axis of the wearer's knee joint. Buckle section 18, strap 20 and belt loop 22 are generally fabricated from leather to maximize the strength and flexibility of these elements.

First support means or semi-circular bracket 26 is fabricated from a thin, semi-circular curved section of aluminum alloy and includes one end which is coupled to upper section 14 of brace element 10 and an opposite end which is coupled to upper section 14 of brace element 12. The ends of bracket 26 are coupled by a pair of rivets to the upper sections of the two brace elements. Bracket 26 maintains a predetermined fixed spacing between the upper portion of brace elements 10 and 12. In a similar manner, a second bracket 28 is provided to couple lower sections 16 of brace elements 10 and 12 together while maintaining a predetermined fixed spacing between the lower portion of the brace elements.

Figure 3:
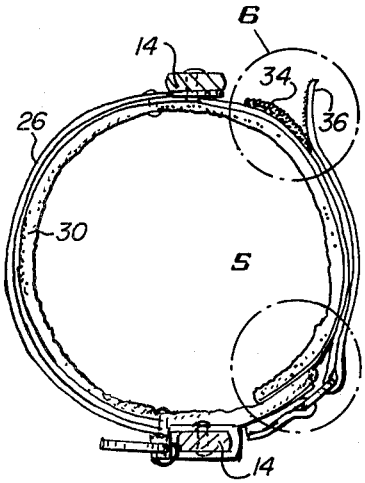
FIG. 3 is a sectional view of the prisoner leg restrainer illustrated in FIG. 2, taken along section line 3—3.

Referring now to FIGS. 2 and 3, the adjustable securing means which adjustably secures brackets 26 and 28 to the wearers leg will now be described in some detail. A two inch wide calfskin strap 30 includes a two inch plastic loop 32. The other end 31 of strap 30 extends a substantial distance from upper brace section 14. A length of Velcro material 34 includes a plurality of upward projecting plastic tooth-like split loops. A Velcro mesh strap 36 is routed through buckle 32 into a position above and facing the plastic split loops on Velcro sections 34. The coupling between strap 30 and the leg of the individual wearing the prisoner leg restrainer is adjusted by varying the point at which the face of strap 36 is coupled to the face of strap 34. Numerous other methods of varying the adjustment of the prisoner leg restrainer to the leg of the wearer are well known and could readily be substituted for the materials described above. However, the above described materials provide a strong, rapidly adjustable connection between the prisoner leg restrainer of the present invention and the leg of the individual wearing the device.

The structure of the adjustable securing means which secures bracket 28 to the leg of the wearer is identical to that described in connection with bracket 26.

Figure 4:
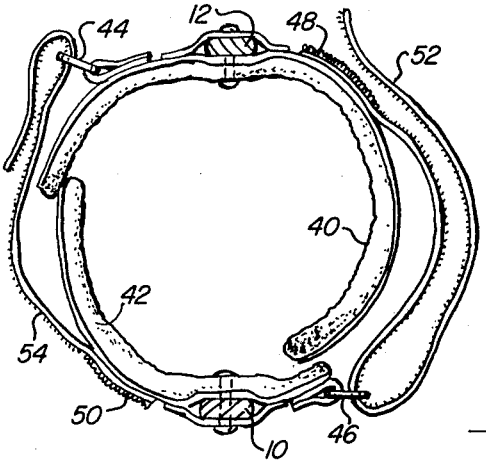
FIG. 4 is a sectional view of the prisoner leg restrainer illustrated in FIG. 2, taken along section line 4—4.
Figure 5:
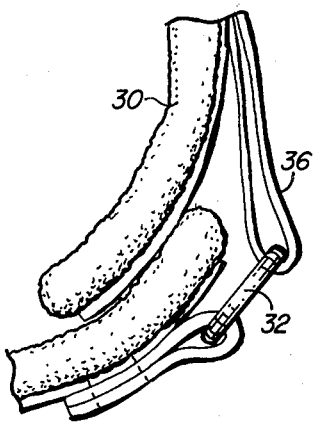
FIG. 5 is an enlarged view of a section of the leg strap illustrated in FIG. 3.
Figure 6:
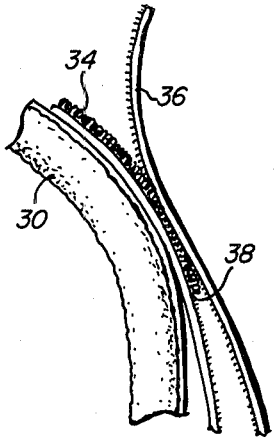
FIG. 6 is an enlarged sectional view of a portion of the leg strap illustrated in FIG. 3.

Referring now to FIGS. 2 and 4, the structure of the ankle strap section of the present invention will be described in some detail. A pair of felt lined, three inch wide leather straps 40 and 42 are coupled respectively to each of the lower sections 16 of brace elements 10 and 12. Two inch long plastic loops 44 and 46 are coupled to each end of straps 40 and 42 as shown. Split loop Velcro straps 48 and 50 and Velcro mesh straps 52 and 54 are coupled as shown and function to mechanically secure the lowest section of the prisoner leg restrainer to the ankle of the wearer in a manner quite similar to that described in connection with the adjustable securing means of bracket 26 above.

Referring now to FIGS. 7A, 7B, 7C, 8 and 9, the structure and function of the automatic locking device of the present invention will be described. Hinge 24 which couples the upper and lower sections of the brace elements together includes first and second side pieces 56 and 58 which extend downward from upper section 14 along the upper side surfaces of lower section 16. A hinge pin 60 extends through side pieces 56 and 58 and through the upper section of lower brace section 16. The upper postions of side pieces 56 and 58 are secured by rivets to the lower section of upper brace element 14. The elements of the hinge and automatic locking mechanism are fabricated from steel to preclude excessive wear.

Figure 7A:
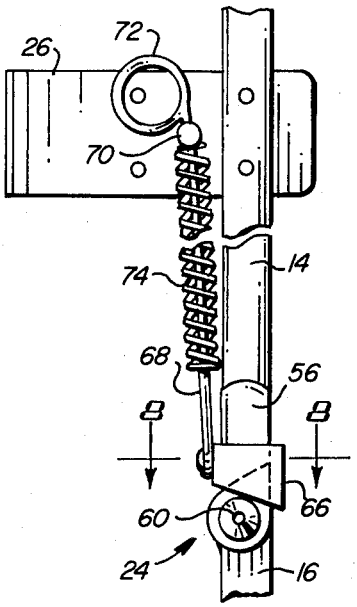
FIGS. 7A, 7B, and 7C illustrate the manner of operation of the automatic locking mechanism for the prisoner leg restrainer.
Figure 7B:
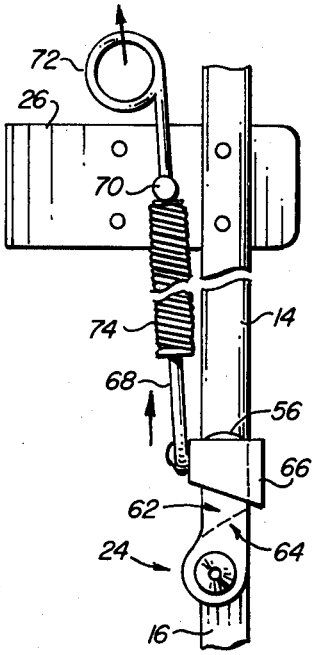
Figure 9:
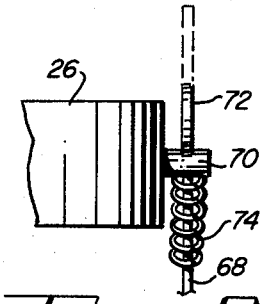
FIG. 9 is a rear view of the release handle for the automatic locking mechanism.
Figure 7C:
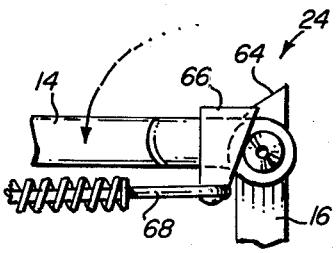

FIGS. 7A, 7B and 7C best illustrate that upper brace section 14 includes flat, downward sloping lower edge 62 while lower brace section 16 includes a flat upward sloping upper edge 64. Thus when brace sections 14 and 16 are in vertical alignment as illustrated in FIG. 7B, angled lower edge 62 and angled upper edge 64 meet and prevent further forward angular displacement of the upper and lower elements of the brace.

Figure 8:
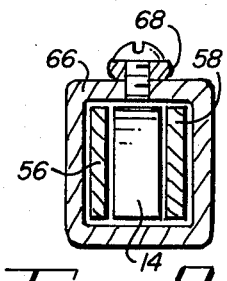
FIG. 8 is a sectional view of the automatic locking mechanism illustrated in FIG. 7A, taken along section line 8—8.

The automatic locking mechanism includes a collar 66 having a rectangular cross section as indicated in FIG. 8 and a rectangular, hollow channel in the center region thereof. The lower edge of collar 66 is angled upward to permit the collar to extend the maximum possible downward distance toward hinge pin 60. An unlocking mechanism includes a shaft 68 which is coupled at one end to collar 66 and which is slidably coupled at the other end to bracket 26 by means of an aperture in post 70. A handle 72 is provided at the end of the unlocking mechanism to permit the unlocking mechanism to displace collar 66 between a first raised position and a second lowered position. Biasing means in the form of a spring 74 surrounds shaft 68. One end of spring 74 abutts post 70 while the other end of spring 74 is maintained in position by a larger diameter flattened area in the lower region of shaft 68. The spring biasing force provided by spring 74 displaces collar 66 downward into the second or locked position in which collar 66 surrounds portions of both the upper and lower sections of brace element 10. The brace is thus immobilized and locked in position so that the wearer is not able to bend his knee joint and must walk stiff legged.

In order to permit a prisoner wearing the leg restrainer of the present invention to assume a seated position, handle 72 can be grasped by a finger and displaced upward, raising collar 66 above the intersection between lower edge 62 and uppr edge 64 of brace element 10 and permitting unrestricted aft rotation or pivoting of the leg brace. Once the leg restrainer has been unlocked the prisoner may flex his knee in a normal manner.

As a prisoner wearing the leg restrainer of the present invention stands up after being in a seated position with the brace in the unlocked position illustrated in FIG. 7C, the lower, angled front face of channel 66 is deflected upward by inclined face 64 of lower brace section 16. Just as the brace elements assume a position of vertical alignment, a clearance is established between lower section 16 of the brace element and the interior channel of collar 66, causing channel 66 to be instantaneously displaced downward into the second or locked position by spring 74. Thus collar 66 is automatically displaced into the second or locked position when the upper and lower sections of brace element 10 are vertically aligned which prevents rearward pivotal movement of the hinge of the leg restrainer.

As can best be seen by referring to FIGS. 1 and 2, a twenty degree knee flextion is provided when the leg restrainer of the present invention is in the locked position. This twenty degree knee flextion angle is provided to prevent the leg from extending fully to minimize the ambulatory gate of the wearer by paralleling the anatomical alignment of the human leg. FIG. 10 illustrates that the curvature of brace element 12 which contacts the inner leg surface of the wearer's right leg is curved in a manner to accomodate the curvature of the medial tibia flare, while the curvature of the lower section of the outside of brace element 10 is curved somewhat differently to accomodate the anatomical flair of this different section of the knee joint.

It will be apparent to those skilled in the art that the disclosed prisoner leg restraint may be modified numerous ways and may assume many embodiments other than the preferred forms specifically set out and described above. Accordingly, it is intended by the appended claims to cover all such modifications of the invention which fall within the true spirit and scope of the invention.

I claim:

1. A prisoner leg restrainer attachable to one leg of a prisoner wearing a belt, said leg restrainer comprising:

a. first and second brace elements positionable vertically along the inner and outer sides of the leg, each brace section including
   i. an upper section having a flat, downward sloping edge
   ii. a lower section having a flat, upward sloping upper edge
   iii. a hinge pivotally coupling the upper and lower sections together to permit rearward pivotal movement of the lower sections of said leg restrainer with respect to the upper sections of said leg restrainer;

b. first support means coupled to the upper sections of said first and second brace elements for maintaining a predetermined fixed spacing between said first and second brace elements;

c. second support means coupled to the lower sections of said first and second brace elements for maintaining a predetermined fixed spacing between said first and second brace elements;

d. means coupled to said first and second brace elements for securing the upper and lower sections of said leg restrainer to the upper and lower portions of the leg of the prisoner;

e. an automatic locking mechanism for preventing rearward pivotal movement of the lower sections of said leg restrainer when engaged and for automatically engaging when the upper and lower sections of said leg restrainer are in vertical alignment, said locking mechanism including
   i. a collar coupled and surrounding one of said brace elements and displaceable downward along said brace element from a first retracted position above the upper edge of the upper section of said brace element into a second locked position in which said collar surrounds portions of both the upper and lower sections of said brace element
   ii. biasing means coupled to said collar and to said brace element for biasing said collar into the second position, whereby said collar is automatically displaced into the second position when the upper and lower sections of said brace elements are vertically aligned to prevent rearward pivotal movement of the lower sections of said leg restrainer with respect to the upper sections of said brace.

2. The prisoner leg restrainer of claim 1 further including a strap coupled to the upper section of one of said brace elements and to said belt for securing said leg restrainer in a fixed vertical position with respect to the prisoner's leg.

3. The prisoner leg restrainer of claim 1 wherein said biasing means is a spring.

4. The prisoner leg restrainer of claim 1 wherein said hinge further includes first and second side pieces, each coupled to one side of the lower end of the upper section of said brace element and extending downward along the upper side surfaces of the lower section of said brace element, and a hinge pin extending laterally through said first and second side pieces and the lower section of said brace element.

5. The prisoner leg restrainer of claim 1 wherein said automatic locking mechanism further includes a stop coupled to the upper portion of the lower section of said brace element for limiting the downward displacement of said collar when said collar is displaced into the second position.

6. The prisoner leg restrainer of claim 1 wherein said first support means includes a semi-circular strap which abuts the rear surface of the prisoner's leg.

7. The prisoner leg restrainer of claim 6 wherein said second support means includes a semi-circular strap which abuts the rear surface of the prisoner's leg.

8. The prisoner leg restrainer of claim 1 wherein said securing means includes a first strap coupled to the upper sections of said first and second brace elements, said first strap including means for permitting the ends of said first strap to be wrapped around the prisoner's leg and adjustably secured together.

9. The prisoner leg restrainer of claim 8 wherein said securing means includes a second strap coupled to the lower sections of said first and second brace elements, said second strap including means for permitting the ends of said stap to be wrapped around the prisoner's leg and adjustably secured together.

10. The prisoner leg restrainer of claim 9 wherein said adjustable securing means of said first and second straps includes a male velcro section coupled to one end of said straps and a female velcro strap coupled to the other end of said strap.

11. The prisoner leg restrainer of claim 9 wherein said adjustable securing means includes:

a. a loop secured to a first end of said strap;

b. a male velcro section secured along a region of said straps inset from a second end of said straps; and c. a female velcro strap having one end secured to the end of said male velcro section closest to the first end of said strap, the second end of said female velcro section being threaded through said loop, whereby the position of said female velcro strap is adjusted with respect to said loop and said female velcro section is mechanically secured to the face of said male velcro section to adjustably secure the prisoner leg restrainer to the leg of the prisoner.

12. The prisoner leg restrainer of claim 5 wherein said automatic locking mechanism further includes means coupled to said collar for displacing said collar from the second position to the first position to unlock said locking mechanism.

13. The prisoner leg restainer of claim 12 wherein said unlocking means is further coupled to the upper section of said brace element.

14. The prisoner leg restrainer of claim 13 wherein said unlocking means includes a handle.

15. The prisoner leg restrainer of claim 2 wherein said strap includes a loop for permitting the belt to pass through said loop.

* * * * *